United States Patent [19]

Feighery et al.

[11] 4,256,269

[45] Mar. 17, 1981

[54] CARPET ROLL FORMING APPARATUS AND METHOD

[75] Inventors: James M. Feighery; Dwight E. Howden, both of Dalton, Ga.

[73] Assignee: Tex-Del, Inc., Dalton, Ga.

[21] Appl. No.: 973,960

[22] Filed: Dec. 28, 1978

[51] Int. Cl.[3] ..... B65H 17/12

[52] U.S. Cl. ..... 242/66

[58] Field of Search ..... 242/66, DIG. 3, 65

[56] References Cited

U.S. PATENT DOCUMENTS

| | | | |
|---|---|---|---|
| 492,964 | 3/1893 | Meisel | 242/66 X |
| 3,720,381 | 3/1973 | Rehme | 242/66 X |
| 3,841,578 | 10/1974 | Dorfel | 242/66 |
| 3,850,381 | 11/1974 | Moore | 242/66 |
| 4,171,106 | 10/1979 | Crouse | 242/66 |

*Primary Examiner*—John M. Jillions

*Attorney, Agent, or Firm*—B. P. Fishburne, Jr.

[57] ABSTRACT

A carpet web is delivered on a conveyor to a pair of parallel bed rolls which turn in unison in a common direction and initially are in close side-by-side relationship. A single upper roll parallel to the two bed rolls and midway between them rotates slightly faster than the bed rolls and turns in the same direction as the bed rolls. The upper roll is biased downwardly by a yielding controlled pressure. A rear side swingable roll at an elevation between the bed rolls and upper roll contacts the rear side of the carpet roll being formed by the apparatus to maintain tension thereon and to resist rearward displacement of the carpet roll during its formation. As the carpet roll gains size, the forward bed roll begins to gradually move forwardly in relation to the rear bed roll and upper roll while the upper roll maintains its position to form a broad stance cradle for the growing carpet roll. The rear side roll can now be retracted to its starting position rearwardly of both bed rolls and can be activated as desired to push the completed carpet roll out of the roll forming apparatus onto another conveyor or table. Firmer and more truly cylindrical rolls of carpet are formed which resist sagging. They are better-looking and require less space for transport and storage.

11 Claims, 4 Drawing Figures

CARPET ROLL FORMING APPARATUS AND METHOD

BACKGROUND OF THE INVENTION

Various devices are known in the prior art for rolling up webs of carpet and other similar materials. A common difficulty with all known prior art devices is that the roll of carpet produced in many cases is not sufficiently firm or solid to resist unsightly sagging under its own weight and the ends of the carpet roll frequently are not even, further detracting from the appearance of the product and making it much more difficult to handle and package. The problem is amplified when certain bulky soft yarns are present in the carpet or when bulky products, such as foam plastic webs, are being rolled.

Thus, the main objective of the present invention is to deal completely with this problem in the prior art through the provision of an improved roll forming apparatus and method which produces a roll of carpet or similar product which has increased and uniform density throughout, is much more nearly cylindrical with even end faces and which will not sag or deform appreciably. Thus, the finished carpet roll can be handled and packaged much more easily, is better looking when displayed to customers and takes up substantially less space in a transport truck or on a storage rack.

Other specific features and advantages of the invention will appear in the following description.

The following United States patents are examples of the prior art devices: U.S. Pat. Nos. 2,961,182; 3,045,940; 3,250,484; 3,850,381; 3,931,940; 4,000,863; 4,002,308.

While these prior art devices are fully capable of rolling various types of carpet and similar materials, they do not possess the ability to compactly and solidly form rolls of carpet which embody high bulk yarn, or rolls of such material which will resist sagging and retain a good cylindrical shape during handling and packaging. The prior art devices are incapable of the particular mode of operation which accomplishes these objectives in the present invention.

BRIEF DESCRIPTION OF THE DRAWINGS

Referring to the accompanying drawings forming a part of the application.

DETAILED DESCRIPTION

Figure 3:
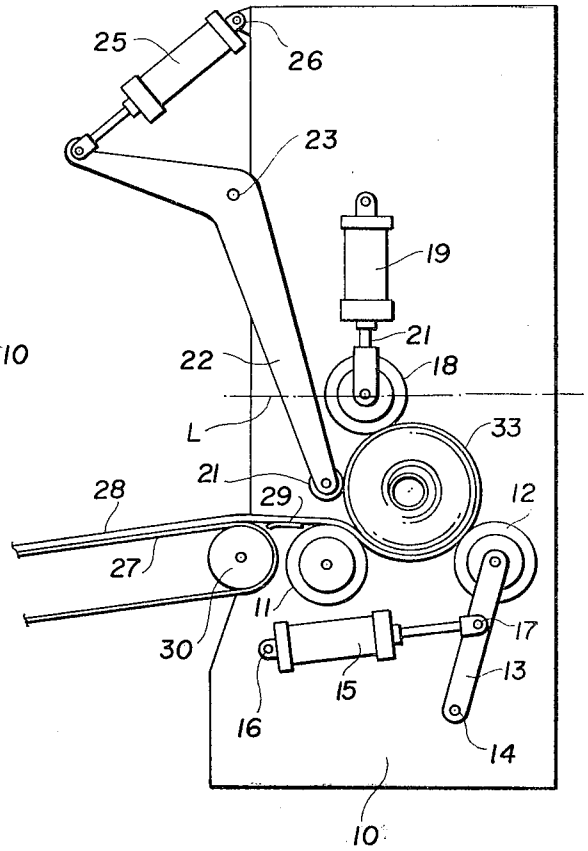
FIG. 3 is a similar view of the apparatus in a final or near final stage of operation.

Referring to the drawings in detail wherein like numerals designate like parts, the numeral 10 designates the frame of a carpet rolling apparatus on which are mounted for simultaneous rotation in one direction a pair of bed rolls 11 and 12. The two bed rolls are driven in unison by conventional means, not shown, well known in the art. The rearward bed roll 11 is a fixed horizontal axis driven roll and the forward bed roll 12 is a horizontal axis movable or swingable roll journaled on support arms 13 whose lower ends are pivoted at 14 to the frame of the apparatus. The arms, with the forward bed roll 12, are swung forwardly and rearwardly relative to the fixed axis rear bed roll 11 by pneumatic cylinder means 15 having a cylinder pivot 16 on the frame 11 and a piston rod pivot 17 on the arm 13. The two bed rolls 11 and 12 are driven at the same speeds of rotation during the operating cycle of the apparatus.

Figure 1:
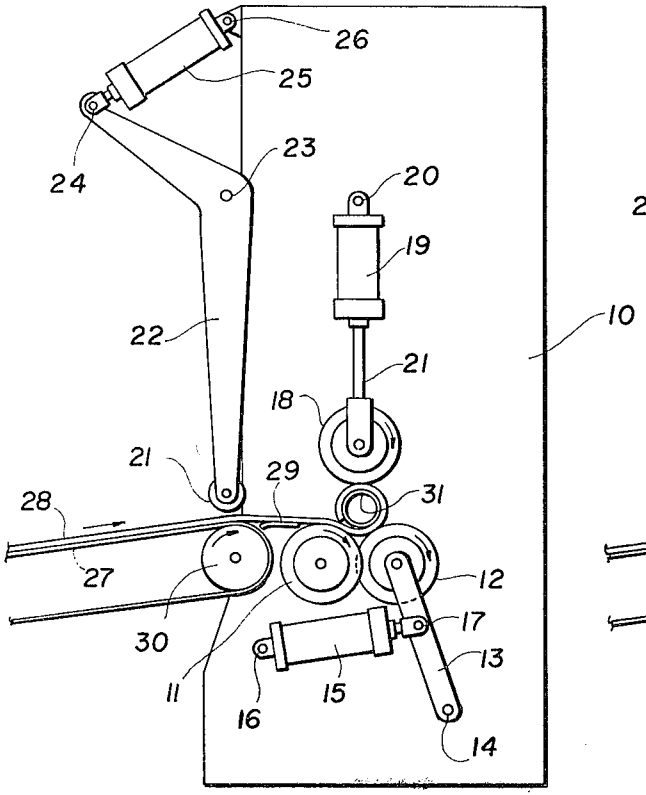
FIG. 1 is a side elevation of a carpet roll forming apparatus according to the invention during a first stage of its operation.

The roll forming apparatus further comprises an upper horizontal axis roll 18 above and midway between the bed rolls 11 and 12 when the swingable bed roll 12 is in its rearmost retracted position shown in FIG. 1. The upper roll 18 is driven in rotation by conventional means, not shown, in the same direction as the two bed rolls 11 and 12 but at a slightly greater speed of rotation. The upper roll 18 is biased downwardly or "counterbalanced" by a pneumatic cylinder-piston unit 19 whose cylinder is pivoted at 20 to the frame 10 and whose piston rod 21 is secured to the journals for the upper roll 18.

A fourth smaller diameter horizontal axis stabilizing and eject roll 21 is arranged at an elevation between the bed rolls 11 and 12 and the upper roll 18 and rearwardly thereof. The roll 21 is carried by bell cranks 22 pivoted as at 23 to the apparatus frame 10 and having further pivotal connections at 24 with the rods of pneumatic cylinders 25, which in turn are pivoted at 26 to the frame 10.

An inclined conveyor 27 supports and feeds a web 28 of carpet or similar material forwardly beneath the roll 21 when the latter is fully retracted, FIG. 1, and across a fixed horizontal support plate 29 between the fixed axis bed roll 11 and the adjacent conveyor roll 30. Referring to FIG. 1, the leading end of the carpet web 28 initially passes over bed roll 11 and under a core 31 which is positioned as shown and onto the other bed roll 12. The leading end of the carpet web is carried around the core 31 and under the upper roll 18 and back down to bed roll 11 where the leading end of the web is tucked in to start the formation of a spiral around the core element 31. The first wrap of the web 28 around the core is controlled by a conventional starting apparatus, now shown, which is not a part of the present invention.

Figure 2:
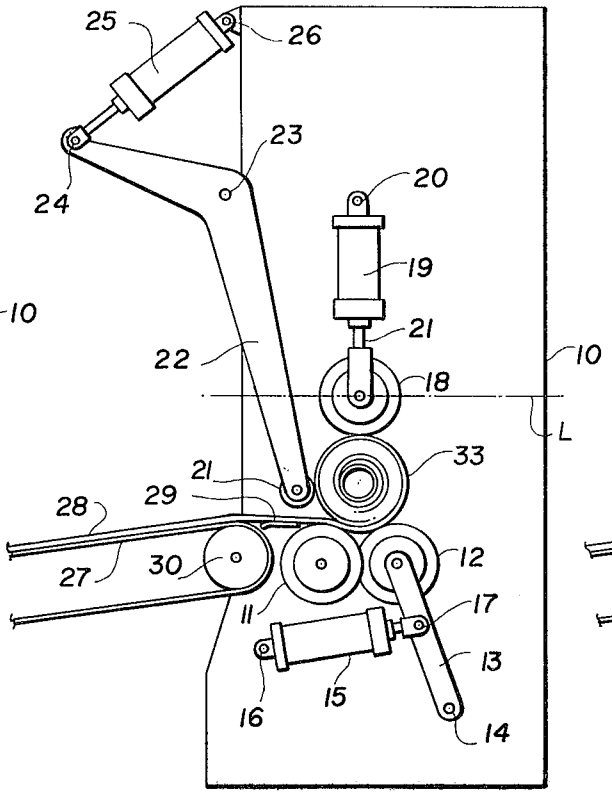
FIG. 2 is a similar view of the apparatus in an intermediate stage of operation.

The two bed rolls 11 and 12 rotate at the same speed and at surface speeds slightly greater than the surface speed of the conveyor 27. This imparts tension to the web 28 and eliminates any wrinkles which may be present. The slightly greater speed of the upper roll 18 compared to the two bed rolls 11 and 12 applies constant tension to the carpet web being rolled up. The upper roll 18 is biased or counterbalanced by the cylinder 19, as stated, and the counterbalancing force against the top of the carpet roll being formed is adjustable by means of a pressure regulator 32, FIG. 4. This counterbalancing of the upper roll 18 serves two purposes in the invention. Firstly, it establishes the degree of carpet pile compaction and, secondly, the degree of tension on the web being wound up. This tension is a function of the slippage or lack of slippage between the three contact points between the roll of carpet and the three driving rolls 11, 12 and 18. As depicted in FIGS. 1 and 2, the upper roll 18 can travel or adjust vertically as the carpet roll 33 gradually grows in diameter.

Referring to FIG. 2, when the carpet roll 33 has grown to a diameter that will enable the rear side swinging roll 21 to clear the starting mechanism, not shown, the roll 21 will swing forwardly on the axis of pivots 23, under the influence of the cylinders 25 to make contact with the rear of the carpet roll 33 being formed in the apparatus. This contact maintains the tension on the carpet web produced by the action of the three driving rolls 11, 12 and 18, and also prevents the carpet roll 33 from being displaced rearwardly off of the cradle support provided by the two rolls 11 and 12, FIG. 2, which are still in their closest relative positions.

At the time of contact of the roll 21 with the rear side of the carpet roll 33, or somewhat later, the forward bed roll 12 begins to swing forwardly on the axis of pivots 14 under influence of cylinders 15 which are coordinated, FIG. 4. The swinging speed of the movable bed roll 12 is under control of a flow control valve 34 whereby the roll 12 can move gradually away from the roll 11 as the carpet roll 33 continues to grow in diameter in the apparatus. Prior to the movement of the bed roll 12, FIG. 2, the initial growth of the carpet roll 33 in the apparatus was accommodated by the gradual rising of the upper roll 18 to the level L against the yielding adjustable counterbalancing force on this upper roll exerted through the cylinder 19 in conjunction with the pressure regulator 32. During the gradual movement of the bed roll 12 away from the fixed axis roll 11, the upper counterbalanced roll 18 will not descend below the level L due to proper adjustment of the pneumatic components controlling the biasing or counterbalancing of the roll 18. Thus, the growth in diameter of the carpet roll 33 at this stage of the process is accommodated by the gradual movement of the bed roll 12, while the rolls 11 and 18 maintain their relative positions.

The upper roll 18 is, however, always in a counterbalanced or floating condition through the cylinder 19 and associated controls, and therefore can always move upwardly until the limit of retraction of the piston rod 21 is reached. Thus, if the carpet roll 33 continues to enlarge after the bed roll 12 has reached the limit of its movement away from the fixed roll 11, this growth or enlargement is again accommodated by further upward movement of the roll 18 above the level L if necessary. In all stages of the described operation, the carpet roll 33 continues to be positively rotated by the three driving rolls 11, 12 and 18 as originally described so that the web of carpet is tensioned and the carpet roll is solidly or densely formed. The described mode of operation is in contrast with the known prior art where a movable bed roll moves suddenly from a fully retracted to a fully extended position relative to a fixed bed roll and without the coordinated activity of two additional elements or rolls corresponding to the elements 18 and 21 of this invention. The results obtained are entirely different with this invention compared to the prior art and vastly improved.

FIG. 3 illustrates the stage of the process where the movable bed roll 12 is at its forwardmost position away from the fixed axis roll 11 under influence of cylinders 15. The upper roll 18 has maintained its position at the level L in spite of the growth of the carpet roll 33 from its condition in FIG. 2. The upper roll 18 is now able to rise above the level L somewhat if the carpet roll 33 is allowed to increase beyond the size it has attained in FIG. 3 with the roll 12 fully extended. The apparatus is extremely versatile in its ability to handle the formation of rolls of carpet or similar bulky materials in a range of diameters.

When the conditions illustrated in FIG. 3 are existing, the rear stabilizing roll 21 can be retracted by cylinders 25 to the original position shown in FIG. 1. The weight of the large carpet roll 33 on the now widely spaced bed rolls 11 and 12 is sufficient to prevent displacement of the carpet roll rearwardly. When the carpet roll 33 has been formed to the desired size, for example fifty yards of carpet, the movable bed roll 12 can be retracted to its original position, FIGS. 1 and 2, close to the fixed axis roll 11. The roll 21 can at this time be swung forwardly by cylinders 25 to eject the carpet roll 33 from the apparatus onto a table or conveyor means, not shown. Prior to such ejection, the carpet roll 33 is severed from the web 28 by conventional severing means, not shown.

Figure 4:
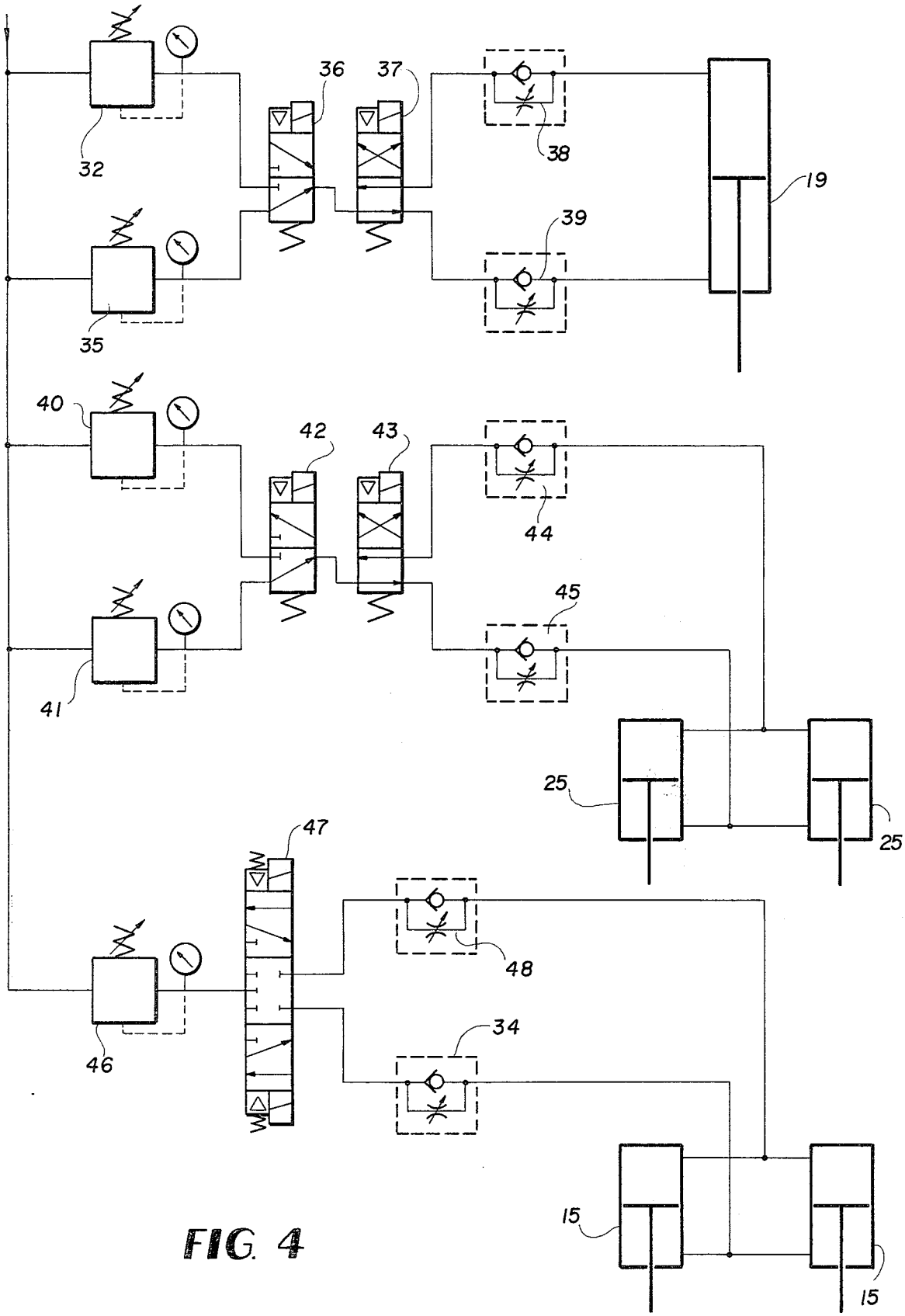
FIG. 4 is a schematic view of a pneumatic control system for the apparatus.

Referring to schematic FIG. 4, the aforementioned regulator 32 is for low pressure or "balance pressure" for the top roll 18 through top roll cylinder 19. Another pressure regulator 35 is for high pressure to raise and lower the top roll 18 through top roll cylinder 19. Valve 36 is a three-way, two position valve and is used to select high or low pressure. Valve 37 is a four-way, two position valve and is used to move top roll 18 up or down by means of top roll cylinder 19. Flow controllers 38 and 39 control the speed of operation of cylinder 19.

Another regulator 40 is for low pressure, and controls the tension roll 21 in the carpet roll-up mode through cylinders 25. A regulator 41 is for high pressure and is used for carpet roll eject mode through cylinders 25. Valves 42 and 43 and flow controllers 44 and 45 operate as described above in connection with the elements 36, 37, 38 and 39.

A regulator 46 is to control air pressure for the movable bed roll or spreader roll 12 through the two cylinders 15. Valve 47 is a four-way, three position valve and controls cylinders 15. When the roll-up operation is stopped, the valve is deactivated and holds the cylinders 15 from extending. When the roll-up operation is again started, valve 47 is reactivated and allows the cylinders 15 to continue extending. Flow controllers 48 and 34 control the extend and retract speed of cylinders 15.

It is believed that the foregoing description of the construction and mode of operation of the apparatus will render apparent to those skilled in the art the advantages of the invention over the known prior art, in terms of producing consistently a firmer, better appearing and space conserving roll of carpet or similar bulky material in accordance with the objective of the invention.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A method of forming a firm substantially cylindrical substantially non-sagging roll from a web of soft bulky material comprising the steps of positioning one end of the web at a roll forming station and initiating the formation of a roll from said web at said station, frictionally rotationally engaging said roll undergoing formation at three circumferentially spaced parallel lines of contact along the length of the roll undergoing formation with two of the lines of contact initially closely spaced apart near the bottom of the roll and the third line of contact located near the top of the roll and between the bottom lines of contact, frictionally driving said roll undergoing formation in the same direction at all three lines of contact and at a somewhat greater rotational speed at the top line of contact than at the bottom two lines of contact with said roll, continuing to maintain said three parallel lines of contact with said roll during the growth of the roll in diameter while the roll is rotating and allowing the top line of contact with the roll to rise relative to the bottom two lines of contact during said growth, gradually separating one of said bottom lines of contact from the other bottom line of contact with said roll following the growth in diameter of the roll to a predetermined degree and during a continuing growth in diameter of the roll while maintaining the top line of contact at least at the level which it had attained at the start of said separation of said one bottom line of contact from the other bottom line of contact with said roll, and engaging one side of the roll undergoing formation along a fourth parallel line of contact approximately at the time when said one bottom line of contact begins to separate from the other bottom line of contact and during at least part of the time when said roll is growing in diameter to stabilize said roll and prevent its displacement laterally from said two lines of contact near the bottom of the roll.

2. The method of claim 1, and said engaging of one side of the roll along said fourth parallel line of contact being at the rear of the roll in relation to the direction of movement of said web and being between said two lines of contact near the bottom of the roll and said one line of contact near the top of the roll.

3. The method of claim 1, and the additional step of ejecting said roll following the completion of its formation to a required size from supportive engagement along said two lines of contact near the bottom of the roll.

4. The method of claim 3, and the additional step of retracting said one bottom line of contact to its original position relative to the other bottom line of contact prior to said ejecting of said roll.

5. A method of forming a firm substantially cylindrical and substantially non-sagging roll from a web of soft bulky material comprising the steps of advancing one end of the web to a roll forming position and initiating the formation of a roll from said web with said roll rotationally supported on a pair of closely arranged horizontal parallel axis bed rolls and with both bed rolls turning in the same direction of rotation at the same speed of rotation, simultaneously contacting the roll undergoing formation near its top by an upper horizontal contact roll which is capable of rising and having an axis parallel to the axes of said bed rolls and rotating simultaneously with the bed rolls in the same direction of rotation as the bed rolls and at a greater speed of rotation than the bed rolls, continuing the rotation of said bed rolls and upper contact roll while they are frictionally engaged with the roll undergoing formation and thereby causing such roll to grow in diameter and during such growth allowing the growing roll to displace the upper contact roll upwardly to accommodate such growth, gradually displacing laterally one of said bed rolls from the other bed roll after the roll undergoing formation has attained a certain diameter and during such gradual displacement of said one bed roll maintaining said upper contact roll at least at the elevation it had assumed prior to the commencement of displacement of said one bed roll, and engaging the rear one side of the roll undergoing formation substantially during the period when said one bed roll is being displaced laterally of the other bed roll to prevent rearward lateral displacement of said roll undergoing formation.

6. An apparatus for producing a firm substantially cylindrical roll from a web of soft bulky material comprising a pair of rotating parallel axis bed rolls each having the same speed and the same direction of rotation, means to displace one bed roll laterally away from and toward the other bed roll during said rotation of the bed rolls, an upper contact roll above and between said bed rolls and turning in the same direction of rotation as the bed rolls and at a greater speed of rotation than the bed rolls and having an axis parallel to the axes of the bed rolls, means biasing said upper contact roll downwardly toward the bed rolls with a yielding force whereby the upper contact roll may be displaced upwardly in response to the growth of a roll of said soft bulky material undergoing formation in the apparatus and with said roll undergoing formation resting on said bed rolls and contacting said upper contact roll, and a movable means engaging one side of the roll undergoing formation between one bed roll and said upper contact roll to stabilize such roll and to prevent lateral displacement thereof in one direction at least during the period when said one bed roll is being displaced laterally away from said other bed roll by said first-named means.

7. An apparatus as defined in claim 6, and said means to displace said one bed roll laterally comprising extensible and retractable cylinder-piston means connected with said one bed roll, and means to support said other bed roll in fixed parallel axis relationship to the displaceable bed roll.

8. An apparatus as defined in claim 6, and said means biasing said upper contact roll comprising a cylinder-piston unit connected with said upper contact roll, and adjustable fluid pressure means including a pressure regulator connected with said cylinder-piston unit.

9. An apparatus as defined in claim 6, and said movable means engaging said one side of the roll undergoing formation comprising a non-powered roller having an axis parallel to the axes of said bed rolls and upper contact roll, and power means connected with said non-powered roller to shift it laterally toward and away from engagement with said roll undergoing formation.

10. An apparatus as defined in claim 9, and said power means comprising extensible and retractable cylinder-piston means remote from said non-powered roller, and swingable support arms for said non-powered roller connected with said last-named cylinder-piston means.

11. An apparatus as defined in claim 6, and means to convey said web to a roll forming position on said bed rolls.

* * * * *